US012569041B2

(12) United States Patent
Klespies

(10) Patent No.: US 12,569,041 B2
(45) Date of Patent: Mar. 10, 2026

(54) WIND-RESISTANCE REDUCING CANOPY STRUCTURE FOR UMBRELLA

(71) Applicant: Ryan R. Klespies, Valparaiso, IN (US)

(72) Inventor: Ryan R. Klespies, Valparaiso, IN (US)

(73) Assignee: Ryan R. Klespies, Valparaiso, IN (US)

( * ) Notice: Subject to any disclaimer, the term of this patent is extended or adjusted under 35 U.S.C. 154(b) by 150 days.

(21) Appl. No.: 18/108,761

(22) Filed: Feb. 13, 2023

(65) Prior Publication Data

US 2023/0255331 A1 Aug. 17, 2023

Related U.S. Application Data

(60) Provisional application No. 63/309,099, filed on Feb. 11, 2022.

(51) Int. Cl.

| | |
|---|---|
| ***A45B 25/18*** | (2006.01) |
| ***A45B 25/02*** | (2006.01) |
| ***A45B 25/12*** | (2006.01) |

(52) U.S. Cl.

CPC ..... *A45B 25/18* (2013.01); *A45B 25/02* (2013.01); *A45B 25/12* (2013.01); *A45B 2025/186* (2013.01)

(58) Field of Classification Search

CPC ..... A45B 25/22; A45B 2025/186
USPC ..... 135/31
See application file for complete search history.

(56) References Cited

U.S. PATENT DOCUMENTS

| | | | | | |
|---|---|---|---|---|---|
| 1,397,794 | A | * | 11/1921 | Romeyn | A45B 25/22 135/31 |
| 2,221,289 | A | * | 11/1940 | Okun | A45B 25/22 135/31 |
| D162,617 | S | | 3/1951 | Benivegna et al. | |
| 3,456,661 | A | | 7/1969 | Farley | |
| 3,557,809 | A | * | 1/1971 | Vazquez | A45B 11/00 135/33.4 |
| 4,804,008 | A | | 2/1989 | Ryder et al. | |
| 4,979,534 | A | | 12/1990 | Johnson et al. | |
| 5,065,779 | A | | 11/1991 | Johnson et al. | |
| D336,982 | S | | 7/1993 | Johnson et al. | |
| 5,368,055 | A | * | 11/1994 | Johnson | A45B 25/22 135/33.7 |
| 5,601,103 | A | | 2/1997 | Dubinsky | |
| 5,678,586 | A | * | 10/1997 | Baksh | A45B 25/22 135/33.7 |
| D408,125 | S | | 4/1999 | Kupferman | |
| 5,890,506 | A | | 4/1999 | Kupferman | |
| D413,198 | S | | 8/1999 | You | |
| 6,006,769 | A | | 12/1999 | Lin | |

(Continued)

*Primary Examiner* — Noah Chandler Hawk
(74) *Attorney, Agent, or Firm* — Boyle Fredrickson S.C.

(57) ABSTRACT

An improved umbrella is provided including a collapsible support structure, a primary canopy disposed over the support structure and defining a number of holes and an upper opening therein, a secondary canopy operably secured to the primary canopy to overlap the number of holes and a tertiary canopy operably secured to the primary canopy to overlap the upper opening. The alignment of the secondary canopy and the tertiary canopy over the holes in the primary canopy enables the dissipation of high air pressure formed within the interior of the umbrella caused by winds contacting the umbrella while maximizing the structural integrity of the umbrella.

10 Claims, 3 Drawing Sheets

(56) References Cited

U.S. PATENT DOCUMENTS

| | | | | |
|---|---|---|---|---|
| 6,173,724 | B1 * | 1/2001 | You | A45B 25/22 135/33.7 |
| 6,202,662 | B1 * | 3/2001 | Lin | A45B 25/22 135/33.7 |
| 6,520,193 | B2 * | 2/2003 | You | A45B 25/22 135/33.7 |
| 8,469,044 | B1 * | 6/2013 | Patel | A45B 25/18 135/33.7 |
| D787,808 | S | 5/2017 | Chaklos et al. | |
| 9,756,912 | B1 | 9/2017 | Haythornwaite | |
| 9,788,617 | B1 | 10/2017 | Chen et al. | |
| 9,986,799 | B1 | 6/2018 | King | |
| D877,484 | S | 3/2020 | Hu | |
| 10,980,321 | B2 * | 4/2021 | Farmer | A45B 25/18 |
| 2003/0159748 | A1 * | 8/2003 | Tung | E04H 15/58 139/117 |
| 2004/0149327 | A1 * | 8/2004 | You | A45B 25/22 135/33.7 |
| 2010/0258151 | A1 * | 10/2010 | Vogt | A45B 25/20 135/33.7 |

* cited by examiner

WIND-RESISTANCE REDUCING CANOPY STRUCTURE FOR UMBRELLA

CROSS-REFERENCE TO RELATED APPLICATIONS

The present application claims priority from U.S. Provisional Patent Application Ser. No. 63/309,099, filed on Feb. 11, 2022, the entirety of which is expressly incorporated herein by reference for all purposes.

BACKGROUND OF THE DISCLOSURE

Umbrellas have been around for centuries with the initial purpose to offer shade from the sun's solar rays. As time progressed, in addition to or separate form providing the initial purpose of providing shade to the user, the concept and designs for umbrellas continued to evolve to meet additional challenges from nature's different elements such as rain, wind, and snow.

Some changes in the design of the umbrella were made to increase the size of the canopy so that the entire head and shoulders of the user were to be covered, or partially enclosed. To enable the user the ability to see through these umbrellas having a larger canopy, the canopy was made of a transparent material. Although this alteration to the canopy did provide additional protection from rain and light wind, it did not fare well in worse conditions where the increased size of the canopy created a greater area for wind to contact and attempt to pull the umbrella out of the grasp of the user.

More particularly, as the wind velocity increased, the canopy would begin to act like a sail. This created a situation where the positive pressure inside the canopy would be so strong the user could no longer keep the umbrella in their hands. In many cases, even when the user could maintain a grip on the umbrella, the umbrella canopy would invert exposing the user to the elements of nature, and ultimately catastrophic failure to the umbrella structure and in particular the canopy.

Therefore, it is desirable to develop an umbrella having a canopy structure that significantly mitigates the issues caused by the positive pressure generated within the canopy by wind or air flow into the canopy.

SUMMARY OF THE DISCLOSURE

According to one exemplary embodiment of the disclosure, to address the high positive pressure created inside the primary canopy of prior art umbrella designs, a second canopy is formed over the primary canopy. In this exemplary embodiment, holes are formed in the primary canopy, such as in a symmetrical arrangement on the primary canopy. The second canopy is disposed over the primary canopy in a position where the secondary canopy covers these holes in the primary canopy. The second canopy can be formed as a single component covering all of the holes, or as a number of individual components or panels with each panel covering a separate hole in the primary canopy.

According to another exemplary embodiment of the disclosure, in addition to the secondary canopy or separately from the secondary canopy, the umbrella can include a tertiary canopy. In this exemplary embodiment, the tertiary canopy is formed of a panel smaller than the secondary canopy that is disposed on the top center of the primary canopy of the umbrella, e.g., in alignment with the central support structure of the umbrella, and over one or more openings formed in the primary canopy. This tertiary canopy provides an additional path for the flow of air out of the primary canopy that creates less resistance to the natural direction of airflow through the opening in the primary canopy as a result of the smaller size of the tertiary canopy.

Accordingly, several advantages of the one or more embodiments of the disclosure are as follows: to provide a natural flow of air through the primary canopy via one or more openings formed in the primary canopy and covered by one or more secondary and/or tertiary canopies in different embodiments, where the secondary and/or tertiary canopies enable air flow out of the primary canopy in manner that reduces the resistance to the air flow through the primary canopy, that increases the ease of use of the umbrella including the secondary and/or primary canopies by the user, and that increases the longevity of effective use of the umbrella having the secondary and/or primary canopies thereon.

Other exemplary embodiments, aspects and features of the present disclosure will be made apparent from the following detailed description of various embodiment taken together with the drawing figures and will be readily apparent to those skilled in the art having knowledge of the structures described therewith. Such objectives, features, benefits and advantages will be apparent from the above as taken into conjunction with the accompanying examples and all reasonable inferences to be drawn therefrom.

BRIEF DESCRIPTION OF THE DRAWING FIGURES

The drawings represent the best mode currently contemplated of practicing the present invention.

DETAILED DESCRIPTION OF THE DRAWING FIGURES

Figure 1:
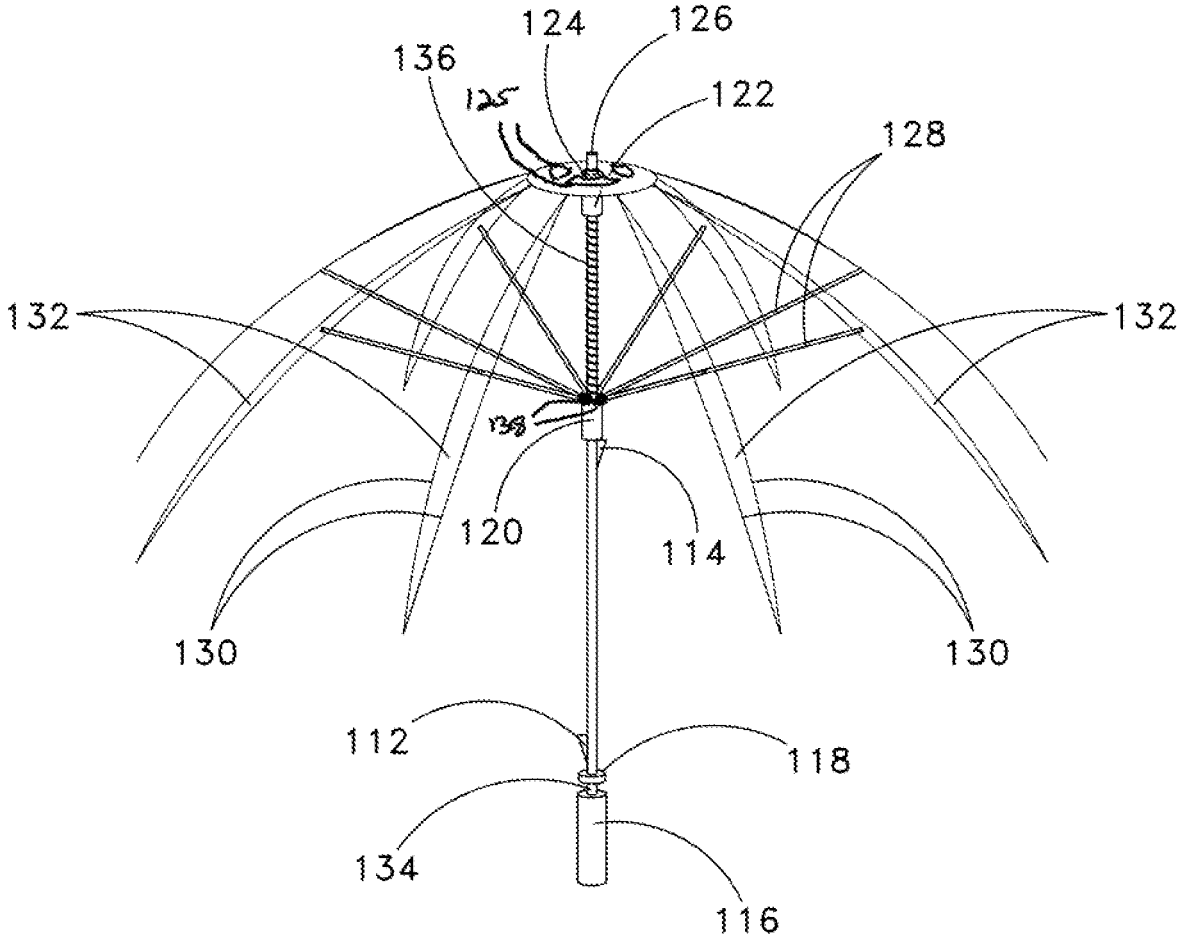
FIG. 1 is a partially broken away, isometric view of a support structure of an umbrella constructed according to an exemplary embodiment of the present disclosure.

With reference now to the drawing figures in which like reference numerals designate like parts throughout the disclosure the following us a summary of the exemplary embodiments of the individual components identified by the various reference numerals in the drawing figures:

- 110 shows a support shaft, which defines a central support axis for the structure.
- 112 and 114 shows a pair of triangle-shaped biased detents that are partially disposed within the shaft 110 but are biased outwardly from the shaft 110
- 116 shows a handle of substantial material connected to a lower end of the shaft 110.
- 118 shows a rib retainer that the ribs 130 can retained within when the umbrella is in a closed position.
- 120 shows a collar that slides up and down the shaft 110 and engageable with the detents 112, 114.
- 122 shows a stop disposed at the top end of the shaft 110 and to which the ribs 130 are secured.
- 124 shows a cap secured to the stop 122 and including a central opening disposed around the top end of the shaft 110.

125 shows an opening in the cap 124

126 shows a top ferrule that is releasable secured to the top end pf the shaft 110 and anchors/retains the stop 122 and the cap 124 on the shaft 110

128 shows a number of stretchers or support arms moveably connect at one end to the collar 120 and to the ribs 130 at an opposite end to selectively move the ribs 130 between collapsed and expanded positions by movement of the collar 120

130 shows individual pairs of ribs connected to the stop 122 and/or cap 124 at one end and defining a hole 132 therebetween, alternatively the rib can be a single piece with the opening 132 formed therein

132 shows the openings disposed between the pairs of separated ribs 130 or formed in a monolithic rib

134 shows a biasing member/coil spring disposed around the shaft 110 between the handle 116 and the rib retainer 118.

136 shows a biasing member/coil spring disposed around the shaft 110 between the collar 120 and the stop 122

138 shows a pivot that pivotally connects between the collar 120 and the pairs of support arms 128 (and optionally separate pivots 138 between arms 128 and ribs 130)

210 shows the substantial material of the panels of the primary canopy disposed between the pairs of ribs 130

211 shows an individual panel forming a part of the second canopy

212 shows a hole formed in the primary canopy or between portions of the primary canopy and aligned with the openings 132

214 shows an upper hole at the top center point of the primary canopy 210 through which the support shaft 110 extends

215 shows openings formed in the primary canopy 210 around the hole 214

216 shows the end caps/tips of each of the pairs of ribs/singular rib 130.

310 shows the panels of a secondary canopy that is secured at each end to the primary canopy 210 covering the openings 132 and holes 212

312 shows flexible horizontal straps interconnecting the panels of the secondary canopy 310

314 shows a tertiary canopy connected over the hole 214.

DRAWINGS—REFERENCE NUMERALS

| | |
|---|---|
| 110 | shaft |
| 112 | bottom detent |
| 114 | top detent |
| 116 | handle |
| 118 | rib retainer |
| 120 | collar |
| 122 | stop |
| 124 | open cap |
| 126 | ferrule |
| 128 | stretcher |
| 130 | rib(s) |
| 132 | hole between ribs |
| 134 | bottom coil spring |
| 136 | top coil spring |
| 138 | pivotal widget |
| 210 | primary canopy |
| 212 | longitudinal holes |
| 214 | upper radius hole |
| 216 | rib tip |

-continued

| | |
|---|---|
| 310 | secondary canopy |
| 312 | strap |
| 314 | tertiary canopy |

FIG. 1 shows an umbrella 10 including a shaft 110 that can be made of wood, metal, fiberglass, or other substantial material. The shape of the shaft 110 can be round, oval, square, triangular, or other shape. The bottom biased detent 112 and top biased detent 114 can be made of wood, metal, fiberglass or other substantial material, and are partially retained within and extend outwardly from the shaft 110 through a slot (not shown) in the shaft 110 by the operation of a biasing member (not shown) disposed within the shaft 110 and engaged with the detents 112,114. At the bottom of the shaft 110 is a handle 116 that can be made of wood, metal, fiberglass, or other suitable material.

The round rib retainer 118 is made of metal, plastic, or other material. The collar 120 is slidably mounted on the shaft 110 and is round and made of wood, plastic, metal, or other material. The thin open cap 124 is round and either ring or disc-shaped, and made of plastic, metal, or other material. The ferrule 126 is round but can be shaped to be complementary to and/or fit over the shape of the shaft 110, such as to be threadedly engaged with the top of the shaft 110. The ferrule 126 can be made of wood, metal, plastic, or other material. The stretchers or support arms 128 and ribs 130 are made of wood, metal, plastic or other material in order to be somewhat flexible. The shape of the stretchers 128 can be u-shaped, round, triangular, or other shapes, and the stretchers 128 are pivotally secured to the ribs 130 and the collar 120 at each end in any suitable manner, such as by pivots 138. In between the rib retainer 118 and the handle 116 is a bottom spring 134 to bias the retainer 118 upwardly along the shaft 110. In between the stop 122 and the collar 120 is a top spring 136 to bias the collar 120 downwardly along the shaft 110. The coiled bottom spring 134 and coiled top spring 136 are each made of the same or different materials, such as a metal, or plastic or other suitable material.

Figure 2:
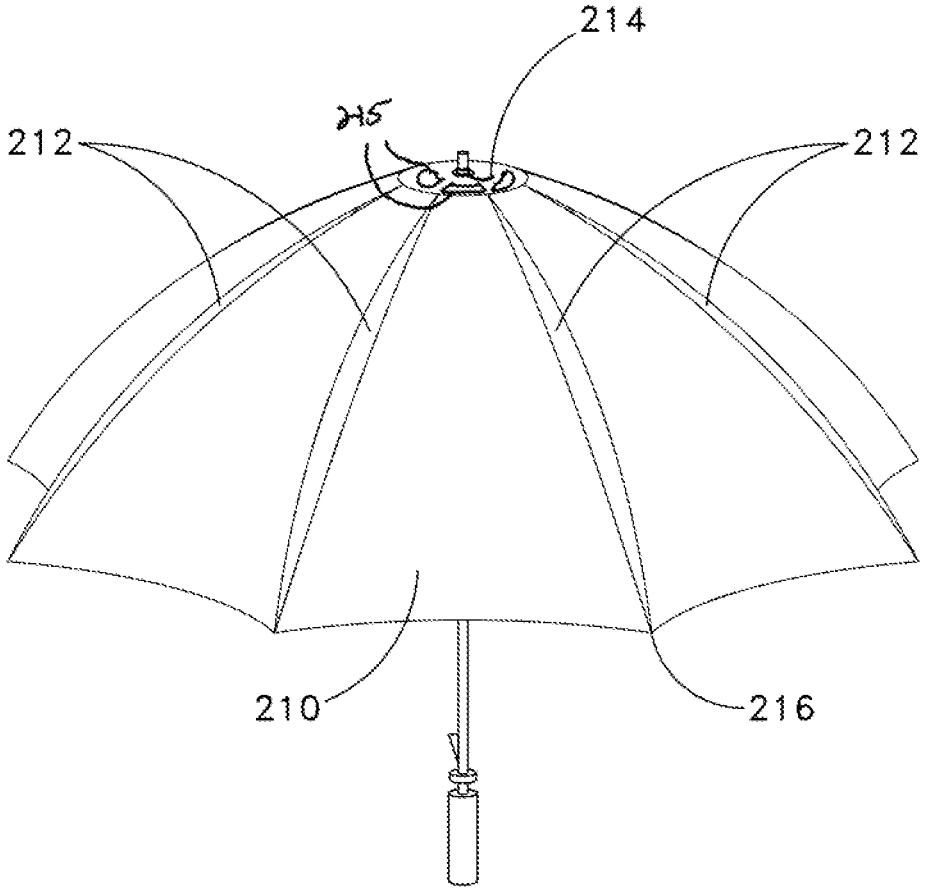
FIG. 2 is a partially broken away, isometric view of the support structure of FIG. 1 including a primary canopy secured thereto.

FIG. 2 shows the primary canopy 210. The primary canopy 210 can be formed of one or more panels 211 of a suitable material, such as a natural or synthetic fabric material. The primary canopy 210 is attached between the pairs of ribs 130 in order to expose the openings 132 formed between each pair of ribs 130.

Figure 3:
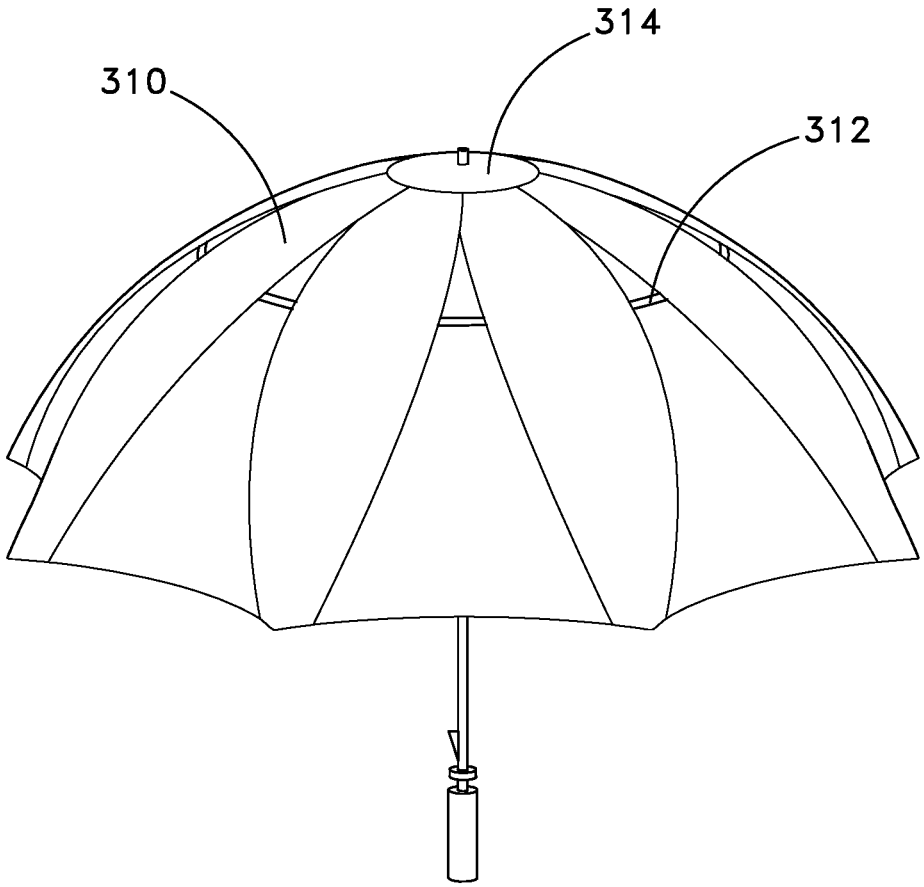
FIG. 3 is an isometric view of the support structure of FIG. 1 including a secondary canopy and a tertiary canopy secured to the support structure over the primary canopy.

FIG. 3 shows the secondary canopy 310. The secondary canopy 310 includes a number of panels 311 of a suitable material, such as a natural or synthetic fabric material. The panels 311 are secured at a bottom end to the primary canopy 310/panels 311 and at a top end to the cap 124 to allow air flow from inside the umbrella 10 thought the openings 132 and around the secondary canopy 310/panels 311. The panels 311 of the secondary canopy 310 are joined by straps 312 formed of a stretchable and/or flexible material to assist in retaining the panels 311 in close conformance with the primary canopy 210 over the openings 132, to allow airflow therethrough but to provide an overlapping structure to prevent water flowing around the panels 311 and through the openings 132.

In another exemplary embodiment, a round tertiary canopy 314 is secured to the top ends of the panels 311 to cover one or more openings 125 that may be formed in the cap 124 and the one or more openings 215 that may be formed in the primary canopy 210. The tertiary canopy 314 is formed a suitable material, such as a natural or synthetic fabric material, and includes a central aperture 316 through which the ferrule 116 extends to retain the tertiary canopy 314 on position on the umbrella 10. The position of the tertiary canopy 314 covering the opening 125 in the cap 124 provides an additional path for air to escape the interior of the umbrella 10 from beneath the tertiary canopy 314 and between adjacent panels 311.

Operation

The embodiment of FIG. 3 shows one entire exemplary embodiment of the umbrella 10 of the present disclosure. The pairs of ribs 130 and the stretchers 128 form the support structure for the umbrella. The top ends of the pairs of ribs 130, which in the illustrated exemplary embodiment define the holes 132 along the entire length of the ribs 130, attach individually around the top notch/stop 122 and/or cap 124 and are pivotal, allowing the structure to open and close. The top notch/stop 122 and cap 124 is in a fixed position on the shaft 110.

When engaged with the collar 120, the top biased detent 114 keeps the frame in an open position. The top detent 114 when pushed into the shaft 110, allows the fame to collapse to a closed position. The top detent 114 will always return to a extended position based upon the bias of the biasing member, e.g., spring, disposed in the shaft 110 and engaged with the detent 114.

At the bottom of the shaft 110 is a handle 116 to allow the user to hold in their hand. Above the handle 116 is a bottom spring 134, which allow the rib retainer 118 to be biased upwardly along the shaft 110 to engage the ribs 130 when placed in the closed position to rest tightly together inside the rib retainer 118. The retainer 118 can be moved downwardly along the shaft 110 against the bias of the spring 134 to disengage the rib 130 from the retainer 118 to enable the ribs 130 to be moved to the open or extended position.

In addition, the structure can be retained in the closed position by the bottom biased detent 112 formed similarly to detent 114. The bottom detent 112, when pressed into the shaft 110, can align with and slide into a groove (not shown) in the collar 120 to keep the structure of the umbrella 10 in the closed position. Above the collar 120 is an upper coil 136 disposed around the shaft that allows the collar 120 to move along the shaft 110 above the upper detent 114 with increased air velocity contacting the umbrella 10. The upper detent 114 functions as a lower stop for the collar 120 in the open position of the umbrella 10. However, the ability of the collar 120 to slide upwardly along the shaft 110 towards the stop 112 enables the umbrella 10 to further expand when the canopies 210,310 and/or 314 are contacted by high winds.

The structure of FIG. 1 has substantial material covering it as shown in FIG. 2. FIG. 2 shows the first layer referred to as the primary canopy 210. A number of holes 212 are formed in the primary canopy 210 by removing substantial portions of the material forming the primary canopy 210 or by forming the primary canopy 210 of a number of panels 211 that define the holes 212 therebetween, which can extend the entire length of the hole 132, and are secured to the ribs 130 and to the cap 124 to retain the panels 211 on the structure of the umbrella 10. All holes 212 are longitudinal and arranged around the circumference of the primary canopy 210 in alignment with the openings 132 formed by the pairs of ribs 130 when the umbrella 10 is in the open position. One or more additional holes 214 are formed at the top of the primary canopy 210.

Looking now at FIGS. 2 and 3, a substantial contiguous material in FIG. 3 shows the second layer disposed over the first layer or canopy 210 and referred to as the secondary canopy 310. The holes 212 are all covered by individual panels 311 the secondary canopy 310 that are spaced from one another. The sections or panels 311 of the secondary canopy 310 are interconnected by flexible and/or stretchable straps 312 and are positioned directly over the holes 212. Each section 311 of the secondary canopy 310 is fastened at the top and bottom ends to the first canopy 210 and/or the cap 124, allowing air to flow out of the holes 212 and around the side panels 311 between the primary canopy 210 and the sides of the panels 311.

The top hole 214 is covered with a substantial contiguous material referred to as the tertiary canopy 314. This tertiary canopy 314 is attached to at least portions of the secondary canopy 310/panels 311 to define airflow spaces between the tertiary canopy 314 and the secondary canopy 310, panels 311, and covers the openings 125,215 to enable air from the interior of the umbrella 10 to pass through the openings 125 and/or 215 and under the tertiary canopy 314 out of the umbrella 10, such as around the tertiary canopy 314 and through the spaces defined between the secondary canopy panels 211. To retain the tertiary canopy 314 over the top of the hole 214, the tertiary canopy 314 can include an aperture (not shown) that is aligned with the opening 214 in the primary canopy 210 and top of the shaft 110, such that the shaft 110 extends through the aperture. The ferrule 116 can then be secured to the shaft 110 to compress and secure the tertiary canopy 314 between the ferrule 116 and the shaft 110.

For each of the primary canopy 210, the secondary canopy 310 and the tertiary canopy 314, the canopies 210, 310 and 314 are readily collapsible and extendable along with the support arms 128 and ribs 130. Further, in alternative embodiments, the secondary canopy 310 and tertiary canopy 314 can be used without one another, such that the openings 125 and/or 215 can be omitted when only the second canopy 310 is present, and the openings 132 and holes 212 can be omitted when only the tertiary canopy 314 is present.

The manner of securing any component of the canopies 210,310,314 to the others can be performed in any suitable manner, such as by mechanical means, such as stitching, or adhesive means, such as a suitable adhesive applied between the components secured to one another.

Advantages

From the description above, a number of advantages of the embodiment of this wind-reducing resistance canopy become evident:

(a) In weather conditions like rain and snow the user will remain dry underneath.

(b) When wind speeds increase air will pass through in a natural direction.

(c) The user will require less strength to operate.

(d) The longevity will increase

Accordingly, the reader will see that the wind-reducing canopy of the embodiment effectively works in poor weather conditions. The embodiment requires no additional knowledge to operate and can provide the desired protection in higher velocity wind. When not in use it will collapse like traditional umbrella's no matter how the frame collapses.

The embodiment can be used for patio umbrellas, beach umbrellas, or any structure that a canopy is required. All users will appreciate the ease of use.

The invention and the manner and process of making and using it are now described in such full, clear, concise and exact terms as to enable any person skilled in the art to which it pertains, to make and use the same. It is to be understood that the foregoing describes preferred embodiments of the present invention and that modifications may be made therein without departing from the spirit or scope of the present invention.

I claim:

1. An umbrella comprising:

a. a collapsible support structure, wherein the support structure comprises:

a. a shaft;

b. a collar slidable along the shaft;

c. a stop disposed at a top end of the shaft; and d. a number of ribs pivotally interconnected with the stop and the collar to move between an extended position and a collapsed position, wherein each rib includes a first end engaged with the stop and a second end spaced from the stop, and a first side extending between the first end and the second end and a second side extending between the first end and the second end, wherein the first side and second side are spaced from one another to define a rib opening therebetween, and b. a primary canopy formed of a number of panels disposed over the support structure, each panel extending between the first side and second side of adjacent ribs while leaving the rib openings uncovered; and c. a secondary canopy operably secured to the primary canopy to overlap the number of holes and the rib openings.

2. The umbrella of claim 1, wherein the secondary canopy is secured at a top end and at a bottom end to the primary canopy, with the sides of the second canopy detached from the first canopy to define an air flow path.

3. The umbrella of claim 2, wherein the second canopy is formed of a number of panels, each panel disposed in an overlapping position over an aligned rib opening.

4. The umbrella of claim 3, wherein adjacent panels are interconnected by straps extending between adjacent panels over the primary canopy.

5. The umbrella of claim 1, wherein the rib opening extends the length of the rib.

6. The umbrella of claim 1, further comprising:

a. a first detent engageable with the collar and disposed adjacent a lower end of the shaft; and b. a second detent spaced upwardly on the shaft from the first detent and engageable with the collar.

7. The umbrella of claim 6 wherein the first detent functions as a lock for the collar in the collapsed position of the umbrella.

8. The umbrella of claim 6, wherein the second detent function as a lower stop for the movement of the collar in an extend position of the umbrella.

9. The umbrella of claim 6, further comprising a spring disposed around the shaft between the collar and the stop.

10. An umbrella comprising:

a. a collapsible support structure comprising:

i. a shaft;

ii. a collar slidable along the shaft;

iii. a stop disposed at a top end of the shaft;

iv. a cap engaged with the stop around the shaft opposite the collar;

v. a ferrule engaged with the shaft over the cap; and vi. a number of ribs pivotally interconnected with the cap and the collar to move between an extended position and a collapsed position, wherein each rib includes a first end engaged with the cap and a second end spaced from the cap, and a first side extending between the first end and the second end and a second side extending between the first end and the second end, wherein the first side and second side are spaced from one another to define a rib opening therebetween;

b. a primary canopy disposed over the support structure to extend between the first side and second side of adjacent ribs while leaving the rib openings uncovered;

c. a secondary canopy including a number of panels connected to the cap at one end and connected to the primary canopy at the opposite end, where the number of panels each extend over a rib opening while exposing the primary canopy between the number of panels.

* * * * *